US007460813B2

(12) United States Patent
Kuwata et al.

(10) Patent No.: US 7,460,813 B2
(45) Date of Patent: Dec. 2, 2008

(54) IMAGE FORMING APPARATUS

(75) Inventors: Takashi Kuwata, Shizuoka-ken (JP); Makoto Izumi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 11/377,283

(22) Filed: Mar. 17, 2006

(65) Prior Publication Data

US 2006/0216060 A1 Sep. 28, 2006

(30) Foreign Application Priority Data

Mar. 25, 2005 (JP) ..... 2005-088184
Apr. 25, 2005 (JP) ..... 2005-127191

(51) Int. Cl.
*G03G 15/00* (2006.01)

(52) U.S. Cl. ..... 399/110; 399/113; 399/114; 399/124

(58) Field of Classification Search ..... 399/110, 399/113, 114, 124, 361, 364, 401
See application file for complete search history.

(56) References Cited

U.S. PATENT DOCUMENTS 5,987,279 A * 11/1999 Ebata ..... 399/113
6,215,970 B1 * 4/2001 Yoshikawa et al. ..... 399/124
7,292,805 B2 * 11/2007 Hashimoto et al. ..... 399/124
2002/0114634 A1 * 8/2002 Ahn et al. ..... 399/110
2004/0114979 A1 * 6/2004 Nanno ..... 399/392
2004/0256792 A1 * 12/2004 Kuwata et al. ..... 271/207
2006/0181004 A1 * 8/2006 Kayama et al. ..... 271/188

FOREIGN PATENT DOCUMENTS

JP 6-186880 7/1994

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A mounting relief portion for mounting a duplex unit on an image forming apparatus main body is provided in an exterior cover pivotally movably provided on the image forming apparatus main body, and capable of opening and closing a sheet conveying path for conveying a sheet fixed by a fixing device, and this mounting relief portion is shaped so as not to contact with a protrusion of the duplex unit mounted on the image forming apparatus main body when the exterior cover is opened.

7 Claims, 19 Drawing Sheets

IMAGE FORMING APPARATUS

BACKGROUND OF THE INVENTION

1. Field of the Invention

The invention relates to an image forming apparatus, and particularly to jam clearance when a duplex unit is detachably mounted.

2. Related Background Art

Among image forming apparatuses such as printers and copying machines, there is one adapted to form a toner image by an electrophotographic recording method, and thereafter transfer the toner image to a sheet, and then apply heat and pressure to the sheet to thereby fix the toner image.

FIGS. 19A and 19B of the accompanying drawings show the construction of a laser printer which is an example of such a conventional image forming apparatus, and this laser printer 201 is comprised of known sheet feeding means, image forming means, a fixing device 250, etc. A duplex unit 300 for performing printing (image formation) on the two sides of a sheet is adapted to be detachably mounted on this laser printer 201.

In such a laser printer 201, the duplex unit 300 is adapted to be inserted from the rear (the left as viewed in FIG. 19A) into the interior of the printer and mounted, but when the duplex unit 300 is thus mounted, a portion of the duplex unit 300 protrudes from the exterior surface of the laser printer 201 to the outside (rear side) thereof. On this protrusion 300*a*, there are disposed, a control substrate 301 for controlling the duplex unit, a fan 302 for cooling the laser printer 201, and a driving portion necessary when two-side printing is performed.

Now, in such a laser printer 201, when the jam of a sheet S1 occurs in a fixing device 250 or downstream of the fixing device 250, the rear cover 210 of the laser printer 201 is adapted to be opened in a case where the duplex unit 300 is not mounted. There is a construction in which when the rear cover 210 is thus opened, the nipping of the sheet S1 by the heating roller 251 and pressure roller 252 is released by nip pressure releasing means (not shown) in operative association with the opening operation of the rear cover 210 so that the clearance of the jamming sheet S1 may become easy. Such a construction is disclosed in Japanese Patent Application Laid-open No. H06-186880. By the rear cover 210 being thus opened and also, the nipping of the sheet S1 by the heating roller 251 and the pressure roller 252 being released, a space permitting the access to the jamming sheet S1 is secured and also, the sheet S1 can be pulled out easily.

On the other hand, in a case where as shown in FIG. 19A, the duplex unit 300 is mounted, the protrusion 300 becomes a hindrance and the rear cover 210 cannot be opened and therefore, when jam clearance is to be done, the duplex unit 300 is first drawn out in the direction indicated by the arrow in FIG. 19A and moved to a jam clearance position, or the duplex unit 300 is intactly drawn out. Thereafter, as shown in FIG. 19B, the rear cover 210 is opened in the direction indicated by the arrow.

In such a conventional image forming apparatus, however, if the duplex unit 300 is not mounted, the number of steps necessary for jam clearance is only one, i.e., the opening of the rear cover 210, but if the duplex unit 300 is mounted, another step of drawing out the duplex unit 300 becomes necessary.

Not only when the sheet S1 stagnates in a duplex path during two-side printing, but also when the sheet S stagnates inside the rear cover 210 during one-side printing, it is necessary to slide the duplex unit 300 and move it to the jam clearance position at first, or to draw out the duplex unit, and thereafter open the rear cover 210. That is, when the duplex unit 300 has been mounted, there has arisen the problem that much time is required for jam clearance and usability (operability) is reduced.

SUMMARY OF THE INVENTION

So, the present invention has been made in view of the circumstances as described above, and has as its object to provide an image forming apparatus which enables jam clearance to be performed without reducing usability even when a duplex unit is mounted.

The present invention provides an image forming apparatus has an image forming portion which forms an image on the sheet, and thereafter discharges the sheet, and a sheet conveying path for guiding the sheet on which the image has been formed by the image forming portion to a discharge portion, an exterior cover pivotally provided on the image forming apparatus main body for opening and closing the sheet conveying path, and a duplex unit provided with a duplex conveying path for again guiding the sheet from the sheet conveying path to the image forming portion to form an image on a second side of the sheet having an image formed on a first side thereof, and adapted to be detachably mounted on the image forming apparatus main body from the exterior cover side, and having a protrusion protruding outwardly from the exterior surface of the exterior cover when the duplex unit has been mounted on the image forming apparatus main body, wherein the exterior cover is provided with a mounting relief portion for mounting the duplex unit on the image forming apparatus main body, and the mounting relief portion is shaped so as not to contact with the protrusion of the duplex unit when the exterior cover is opened.

DESCRIPTION OF THE PREFERRED EMBODIMENTS

The best aspect for carrying out the present invention will hereinafter be described in detail with reference to the drawings.

Figure 1:
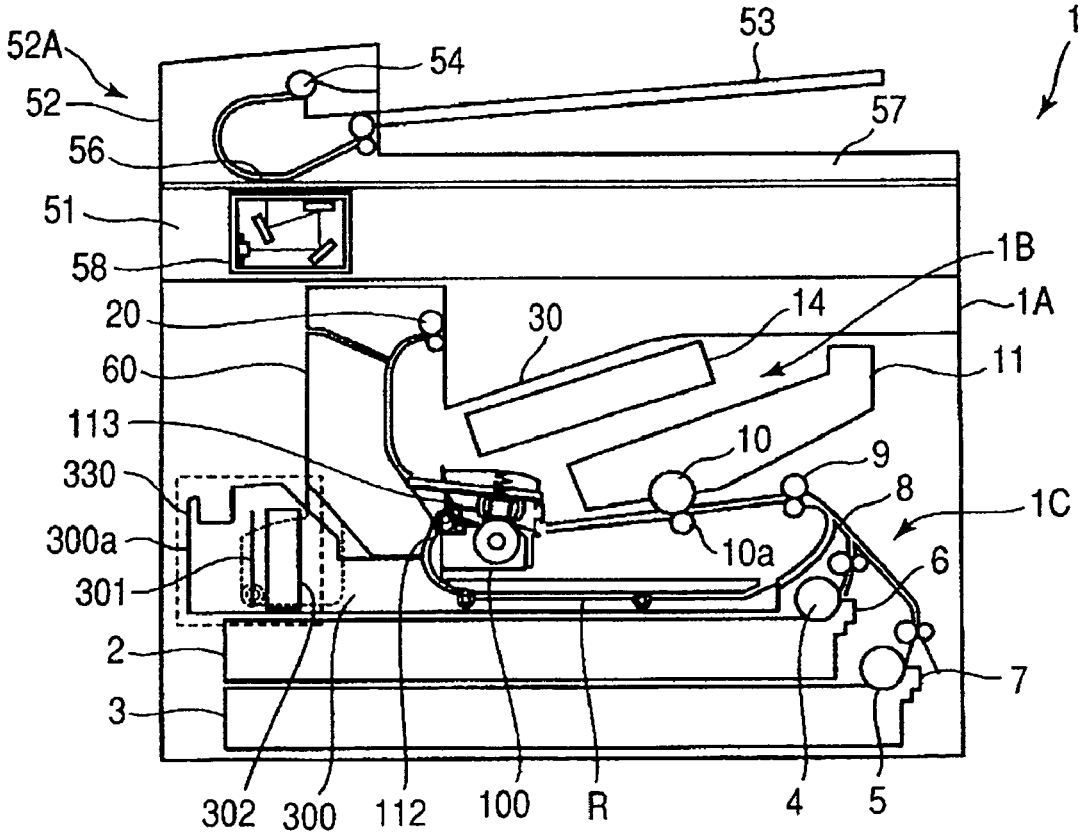
FIG. 1 schematically shows the construction of a laser printer, which is an example of an image forming apparatus according to a first embodiment of the present invention.

FIG. 1 schematically shows the construction of a laser printer, which is an example of an image forming apparatus according to a first embodiment of the present invention.

In FIG. 1, the reference numeral 1 designates a laser beam printer (hereinafter referred to as the laser printer), and the reference character 1A denotes a laser printer main body (hereinafter referred to as the apparatus main body), and this laser printer 1 is provided with an image reading portion 52A provided in the upper portion of the apparatus main body 1A, an image forming portion 1B disposed below the image reading portion 52A, a sheet feeding device 1C for feeding a sheet to the image forming portion 1B, and a duplex unit 300 detachably mounted on the apparatus main body 1A, and used to perform printing (image formation) on the two sides of the sheet.

The image reading portion 52A has a scanner portion 51, which is image reading means, and an ADF (auto document feeder) 52. The ADF 52 serves to separate and convey a plurality of originals stacked on an original stacking tray 53 one by one by a feeding roller 54 and a separating pad (not shown) when information written on an original is to be optically read by the scanner portion 51, and pass the original through an original reading position. Also, this ADF 52 is rearwardly openable and closable about a hinge (not shown) at the rear of the apparatus, and is opened and closed when an original is placed on an original plate (platen glass) 57.

The scanner portion 51 is a popular one in which an optical carriage 58 scans the original placed on the original plate 57 in a lateral direction along a guide shaft (not shown) and at the same time, reads information written on the original, and photoelectrically converts it by a CCD, and during the reading of the original by the ADF 52, the optical carriage 58 is stopped at a predetermined position and reads the original being conveyed.

Also, the image forming portion 1B is provided with a photosensitive drum 10, a laser scanner 14 for forming an electrostatic latent image on the photo-sensitive drum, a developing device (not shown) for developing the electrostatic latent image formed on the photosensitive drum with a toner to thereby form a toner image on the photosensitive drum, a transferring device 10*a* for transferring the toner image formed on the photosensitive drum to a sheet, etc. The reference numeral 11 designates a process cartridge provided with the photosensitive drum 10 and the developing device (not shown).

The sheet feeding device 1C is provided with sheet feeding rollers 4 and 5 for feeding out sheets contained in sheet supplying cassettes 2 and 3, and separating pads 6 and 7 for separating the sheets fed out by the sheet feeding rollers 4 and 5 one by one.

Description will now be made of an image forming operation in the laser printer 1 of such a construction.

When an image is to be formed on the sheet, an original is first set on the original stacking tray 53 of the ADF 52, whereafter a copy button is depressed, whereupon the original is conveyed to an original reading position 56 by the sheet feeding roller 54 of the ADF 52. Then, light is applied from a light source (not shown) to this original, and the reflected light thereof is read by the optical carriage 58, and an image signal read in this manner is forwarded to the laser scanner 14.

Next, the laser scanner 14, when the image signal is thus inputted thereto, applies a laser beam according to the image signal onto the photosensitive drum 10, whereby an electrostatic latent image is formed on the photosensitive drum 10. Thereafter, this electrostatic latent image is developed and visualized as a toner image by the developing device (not shown).

Also, in parallel with such a toner image forming operation, the sheet feeding rollers 4 and 5 are rotated to thereby feed out the sheets from the sheet supplying cassettes 2 and 3, whereafter the sheets are separated one by one by the separating pads 6 and 7, and thereafter registration correction is performed by a pair of registration rollers 9 provided in a conveying route 8. Thereafter, the sheet thus subjected to the registration correction by the pair of registration rollers 9 is conveyed to a transferring portion constituted by the photosensitive drum 10 and the transferring device 10*a*, and in this transferring portion, a voltage of a polarity opposite to that of the toner image is applied to the transferring device 10*a*, whereby the toner image is transferred to the sheet. Next, the sheet to which the toner image has been transferred is conveyed to a fixing device 100 for fixing the unfixed toner image transferred to the sheet on the surface of the sheet, and the sheet is heated and pressurized by this fixing device 100, whereby the toner image is permanently fixed on the sheet. After the toner image has been fixed in this manner, in the case of a one-side copying in which an image is formed only on a first side, the sheet is discharged to a fixing and discharging roller 112 and a fixing and discharging runner 113 constituting discharging means, and further to a discharge tray 30 which is a discharge portion by a pair of discharging rollers 20 in a face-down (FD) state in which the image-formed surface of the sheet faces down.

On the other hand, in the case of two-side copying in which an image is also formed on a second side of the sheet, the sheet having an image already transferred onto one side thereof is reversed at a position to which it has been conveyed by a predetermined amount from the fixing and discharging roller 112 and the fixing and discharging runner 113, and is conveyed to a duplex conveying path R constituted in the duplex unit 300, and thereafter is again conveyed to the image forming portion 1B, and an image is formed on the opposite side of the sheet. After the images have been thus formed on the two sides of the sheet, the sheet is discharged onto the discharge tray 30 by the pair of discharging rollers 20.

Figure 2:
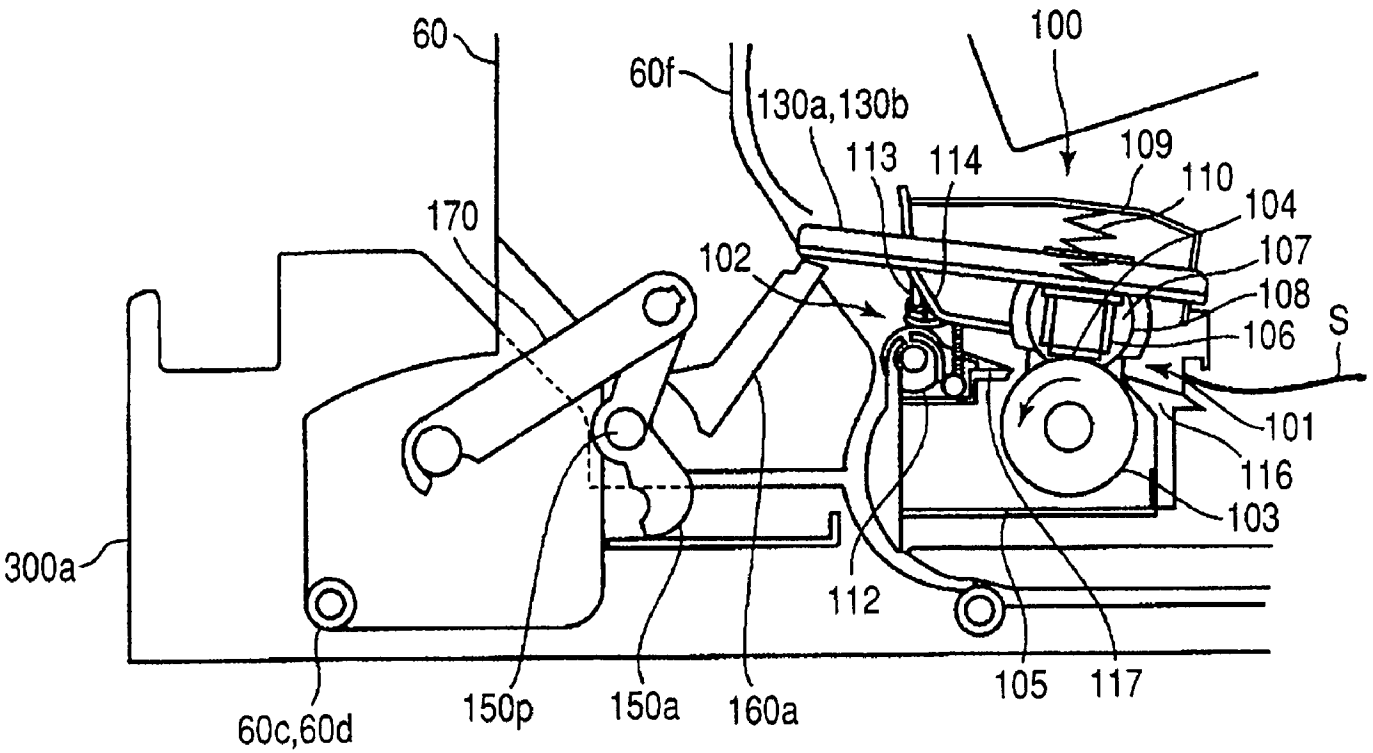
FIG. 2 illustrates the construction of the fixing device of the laser printer.

Now, the fixing device 100, as shown in FIG. 2, is provided with fixing means 101 for performing the fixing of the toner image, and sheet discharging means 102 for performing the discharge of the sheet passed through the fixing means 101.

The fixing means 101 comprises a pressure roller 103 rotatably mounted at a predetermined location in a fixing frame 105, and rotated counter-clockwisely, and a plate-shaped heater 104 mounted on a film guide 107 made integral with a heater stay 106 and contacting with the pressure roller 103 with a predetermined force, and nipping the sheet between it and the pressure roller with predetermined nip pressure. The reference numeral 108 designates cylindrical film, and this cylindrical film 108 is fitted to the outer peripheral surface of the film guide 107 in a rotatable state so as to cover the heater 104.

Also, the heater stay 106 is mounted on the fixing frame 105 for movement in a vertical direction, and the opposite end portions of this heater stay 106 are biased toward the pressure roller 103 side by two fore and rear biasing springs (coil springs) 110 attached to an upper frame 109, through pivotally movable pressure plates 130*a* and 130*b* provided at two fore and rear locations. Thereby, the heater 104 contacts with the pressure roller 103 with the film 108 interposed therebetween with predetermined pressure.

On the other hand, the sheet discharging means 102 comprises a sheet discharging roller 112 rotatably mounted at a predetermined location in the fixing frame 105 and rotated in a counter-clockwise direction, and a sheet discharging runner 113 rotatably mounted on the fixing frame 105 through a sheet discharging upper guide member 114, and contacting with the sheet discharging roller 112 with predetermined pressure and driven to rotate by the latter.

The sheet discharging upper guide member 114 is fixed to the fixing frame 105, and the sheet discharging runner 113 is mounted with respect to this sheet discharging upper guide member 114 for movement in a vertical direction, and is biased toward the sheet discharging roller 112 side by a biasing spring (not shown). Thereby, the sheet discharging runner 113 contacts with the sheet discharging roller 112 with predetermined pressure.

In FIG. 2, the reference numeral 116 designates an entrance guide member for guiding the leading edge of the sheet to the nip of the fixing means 101, and the reference numeral 117 denotes a sheet discharging lower guide member for cooperating with the sheet discharging upper guide member 114 to guide the leading edge of the sheet to the nip of the sheet discharging means 102, and the entrance guide member 116 and the sheet discharging lower guide member 117 are fixed to the fixing frame 105.

When the fixing device 100 of such a construction performs its fixing operation, drive from a drive source (not shown) is transmitted to the pressure roller 103, whereby the pressure roller 103 is rotated in the counter-clockwise direction, and the film 108 is driven to rotate around the film guide 107 by this rotation of the pressure roller 103. Also, the heater 104 is electrically energized and also, the heater 104 is controlled to a predetermined temperature, and the heat of this heater 104 is transmitted to the sheet through the film 108. Also, drive from a drive source (not shown) is transmitted to the sheet discharging roller 112, which is thus rotated in the counter-clockwise direction, and the sheet discharging runner 113 is driven to rotate by the rotation of this sheet discharging roller 112.

The leading edge of the sheet S to which the transfer of the toner image has been completed is guided to the fixing device 100 in such a state by the entrance guide member 116 and comes into the nip of the fixing means 101, whereupon the sheet S is conveyed while being nipped with predetermined pressure by the fixing means 101, and at this time, it is heated and pressurized and the unfixed toner image on the sheet is fixed on the surface of the sheet.

The leading edge of the sheet S passed through the fixing means 101 is guided by the sheet discharging upper guide 114 and the sheet discharging lower guide 117 and comes into the nip of the sheet discharging means 102, whereafter the sheet S is discharged out of the machine while being nipped with predetermined pressure by the sheet discharging means 102.

On the other hand, the duplex unit 300 for performing two-side printing adopts a construction insertable from the left of FIG. 1 into the apparatus main body 1A, and in its mounted state, it forms the duplex conveying path R capable of performing the conveyance of the sheet for performing two-side printing. When this duplex unit 300 is mounted on the apparatus main body 1A, a portion thereof protrudes from an exterior cover, which will be described later.

Figure 3:
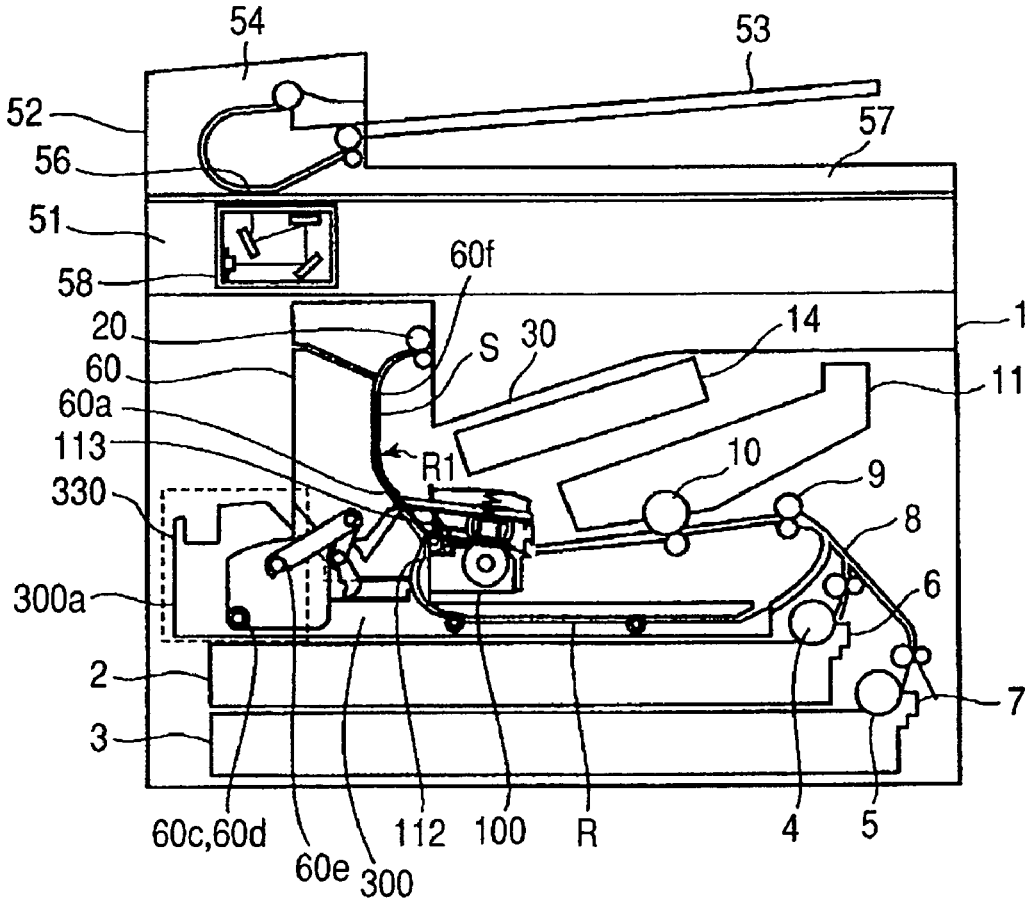
FIG. 3 is another view schematically showing the construction of the laser printer.

In FIG. 3, in the protrusion 300*a* of the duplex unit 300 which protrudes from the exterior surface of the exterior cover 60 encircled by broken line, there are contained a controller 301 necessary to perform two-side printing, a fan 302 for cooling the interior of the apparatus main body, a motor M for driving the roller which will be described later, etc. Also, this duplex unit 300 is detachably mountable on the apparatus main body 1A by sliding, and the protrusion 300*a* of this duplex unit 300 is provided with a handle 330 for slide-operating the duplex unit 300.

Now, as shown in FIG. 3, downstream of the fixing device 100, there is provided the openable and closable exterior cover 60 for opening and closing an FD conveying path R1 which, for the purpose of jam clearance, causes the sheet fixed by the fixing device 100 to travel toward the discharge tray 30, and the duplex unit 300 is adapted to be inserted from this exterior cover 60 into the apparatus main body. In FIG. 3, the reference character 60*f* designates a conveying guide provided on the inner side of the exterior cover 60, and when the exterior cover 60 is closed, this conveying guide 60*f* is adapted to form a side of the FD conveying path R1.

Figure 4A:
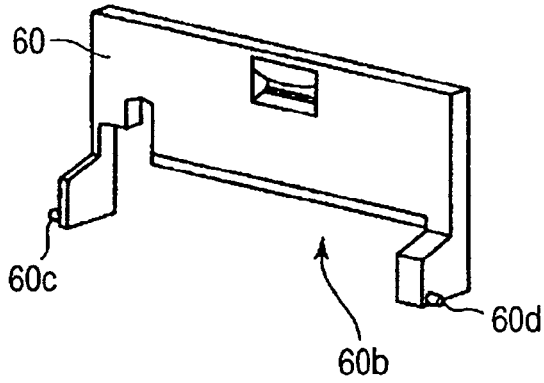
FIGS. 4A, 4B and 4C illustrate an exterior cover provided on the laser printer.

This exterior cover 60, as shown in FIG. 4A, has a mounting relief portion (opening portion) 60*b* constituting a relief portion having such a shape as will not interfere with the duplex unit 300 (the protrusion 300*a* thereof) when the exterior cover 60 has been opened to mount the duplex unit 300 on the apparatus main body 1A and as will be described later. In the present embodiment, the mounting relief portion 60*b* is formed by cutting away the lower portion of the exterior cover 60.

Also, the exterior cover 60 has shafts 60*c* and 60*d* which are rotation centers for rotatably supporting the exterior cover 60 on the apparatus main body 1A, on this side and inner part of the mounting relief portion 60*b* for mounting the duplex unit 300 in a direction orthogonal to a sheet conveying direction, in other words, at each one location, thus two locations in total, outside the exterior surface of the exterior cover 60 of the apparatus main body 1A in the sheet conveying direction.

By the shafts 60*c* and 60*d* of the exterior cover 60 being thus provided outside the exterior surface of the exterior cover 60 in the sheet conveying direction, a space for escaping the protrusion 300*a* of the duplex unit 300, i.e., the mounting relief portion 60*b*, can be made small.

Figure 4B:
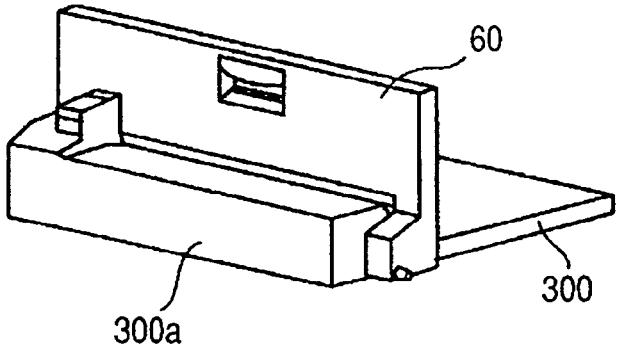
Figure 4C:
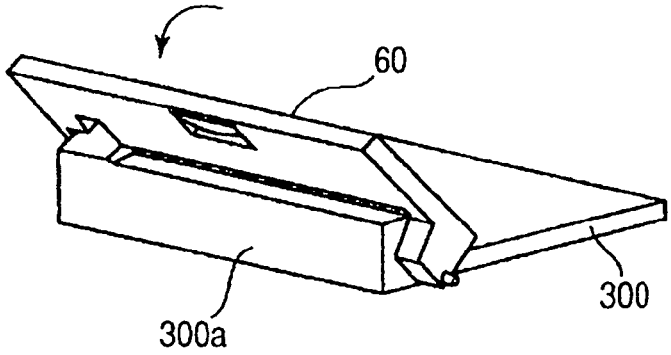

Also, as in the present embodiment, the exterior cover 60 is provided with the mounting relief portion 60*b* of such a shape as will not interfere with the duplex unit 300 when the exterior cover 60 is pivotally moved, whereby even in a state in which the duplex unit 300 has been mounted, it is possible to pivotally move the exterior cover 60 in the direction indicated by the arrow (counter-clockwise direction) from its closed state as shown in FIG. 4B without contacting with the protrusion 300*a* of the duplex unit 300 as shown in FIG. 4C, to thereby open the exterior cover 60. In the upper portion of the exterior cover 60, there is provided a latch (not shown) for performing the positioning thereof with respect to the apparatus main body 1A.

On the other hand, in the present embodiment, there is provided nip pressure releasing means for releasing the nip pressure of the fixing means 101 when the exterior cover 60 has been thus opened.

Figure 5:
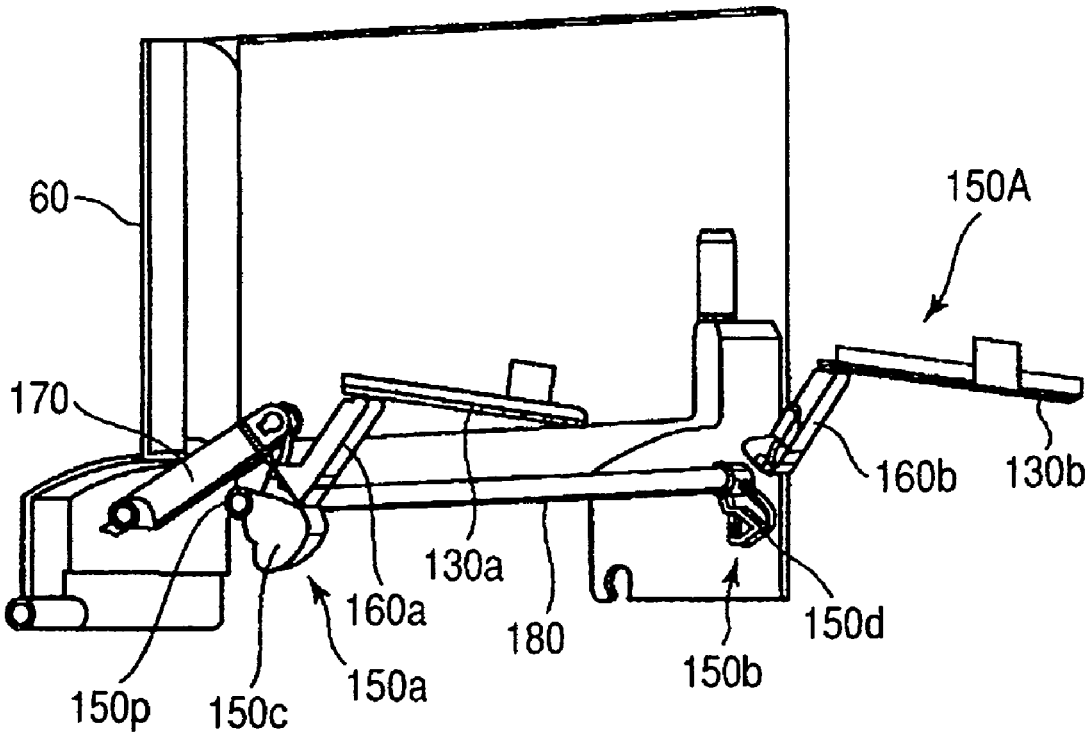
FIG. 5 illustrates the construction of nip pressure releasing means provided in the laser printer.

FIG. 5 shows the construction of such nip pressure releasing means 150A, and this nip pressure releasing means 150A comprises nip pressure releasing cams 150*a* and 150*b* provided on the opposite end portions of the fixing means 101 in a direction orthogonal to the sheet conveying direction, and provided with cam portions 150*c* and 150*d*, respectively, and nip pressure releasing levers 160*a* and 160*b* pressed and moved by the nip pressure releasing cams 150*a* and 150*b*, respectively, and pivotally moving pressure plates 130*a* and 130*b*, respectively. The nip pressure releasing cams 150*a* and 150*b* are fixed to a rotatable shaft 180, and are rotated integrally with the rotatable shaft 180.

Figure 6:
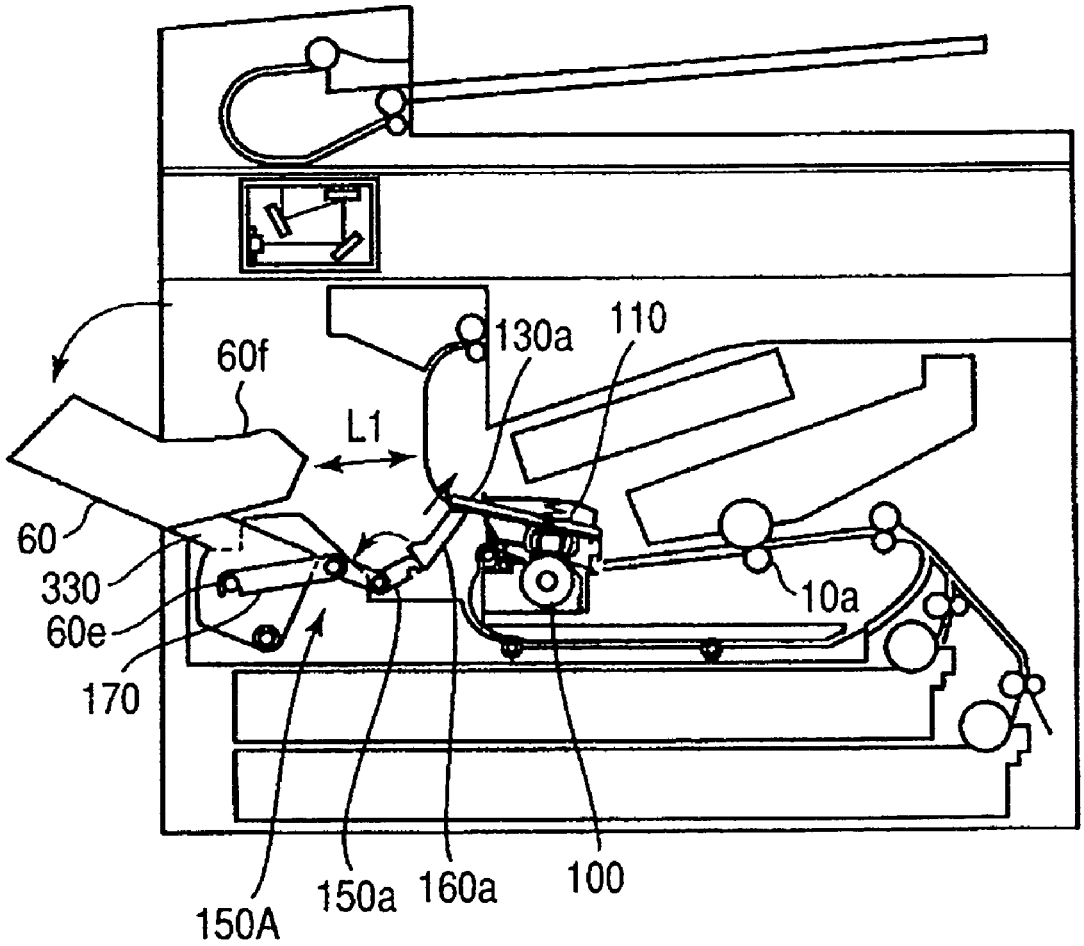
FIG. 6 illustrates the operation of the nip pressure releasing means when the exterior cover is opened.

Here, one nip pressure releasing cam 150*a* is connected to a link 170 having one end thereof connected to the exterior cover 60, and when the exterior cover 60 is opened as shown in FIG. 6, the fulcrum 60*e* of the link 170 provided on the exterior cover 60 is moved in the counter-clockwise direction from the position shown in FIG. 3, and along therewith, the link 170 is moved to the outside as shown in FIG. 6, and by this movement of the link 170, one nip pressure releasing cam 150*a* and the other nip pressure releasing cam 150*a* are counter-clockwisely rotated.

When the nip pressure releasing cams 150*a* and 150*b* are thus counter-clockwisely rotated, the cam portions 150*c* and 150*d* provided on the nip pressure releasing cams 150*a* and 150*b*, respectively, move the nip pressure releasing levers 160*a* and 160*b*, respectively, in the direction indicated by the arrow (obliquely upwardly) in FIG. 6. Further, by such movement of the nip pressure releasing levers 160*a* and 160*b*, the pressure plates 130*a* and 130*b* are clockwisely pivotally moved to thereby compress the biasing springs 110 in a direction opposite to the biasing direction of the heater stay 106, and release the force biasing the heater stay 106 toward the pressure roller 103 side. Thereby, the pressure contact of the fixing means 101, i.e., the pressure contact between the heater 104 and the pressure roller 103, is released, and the nip pressure to the sheet is released.

When the exterior cover 60 is pivotally moved to a predetermined angle, the pivotal movement of the exterior cover 60 is regulated by a stopper (not shown). When the exterior cover 60 is pivotally moved to the predetermined angle as described above, the FD conveying path R1 is opened, and a space for having access to a jamming sheet stagnating in the FD conveying path R1 can be sufficiently secured.

As described above, provision is made of the nip pressure releasing means 150A operatively associated with the exterior cover 60, and the exterior cover 60 is opened so as to release the nip pressure of the fixing means 101, whereby even in a state in which the duplex unit 300 has been mounted, if the exterior cover 60 is opened, the jam clearance of the sheet stagnating in the fixing means 101 can be easily performed without the duplex unit 300 being moved.

Now, in the present embodiment, design is made such that when the exterior cover 60 has been opened, the handle 330 for sliding the duplex unit 300 is, hidden by the pivotally moved exterior cover 60. By the handle 330 being thus hidden by the opened exterior cover 60, there is brought about a state in which the duplex unit 300 cannot be slid at the jam clearance position, whereby the duplex unit 300 can be prevented from being drawn out by mistake to thereby damage the sheet stagnating in the duplex unit 300.

On the other hand, if the exterior cover 60 is closed after jam clearance has been done, the fulcrum 60*e* of the link 170 provided on the exterior cover 60 is first clockwisely moved and the link 170 is moved to the inside, and along therewith, the nip pressure releasing cam 150 is also clockwisely rotated. Then, by this rotation of the nip pressure releasing cam 150, the cam portions 150*c* and 150*d* moves the nip pressure releasing levers 160 obliquely downwardly as viewed in FIG. 6. Further, by such movement of the nip pressure releasing levers 160*a* and 160*b*, the pressure plates 130*a* and 130*b* are counter-clockwisely pivotally moved and also, the heater stay 106 is biased toward the pressure roller 103 side by the compressed biasing spring 110, and the heater 104 comes into pressure contact with the pressure roller 103, and nip pressure against the sheet is generated.

As described above, the exterior cover 60 is provided with the mounting relief portion 60*b* for mounting the duplex unit 300 on the apparatus main body 1A, and the shape of this mounting relief portion 60 is made into such a shape that when the exterior cover 60 is opened, the mounting relief portion does not contact with the protrusion 300*a* of the duplex unit 300 mounted on the apparatus main body 1A, whereby even when the duplex unit 300 has been mounted, the exterior cover 60 can be opened without the duplex unit 300 being moved. Thereby, even when the duplex unit 300 has been mounted, jam clearance can be performed without usability being reduced.

Description will now be made of a second embodiment of the present invention.

Figure 7:
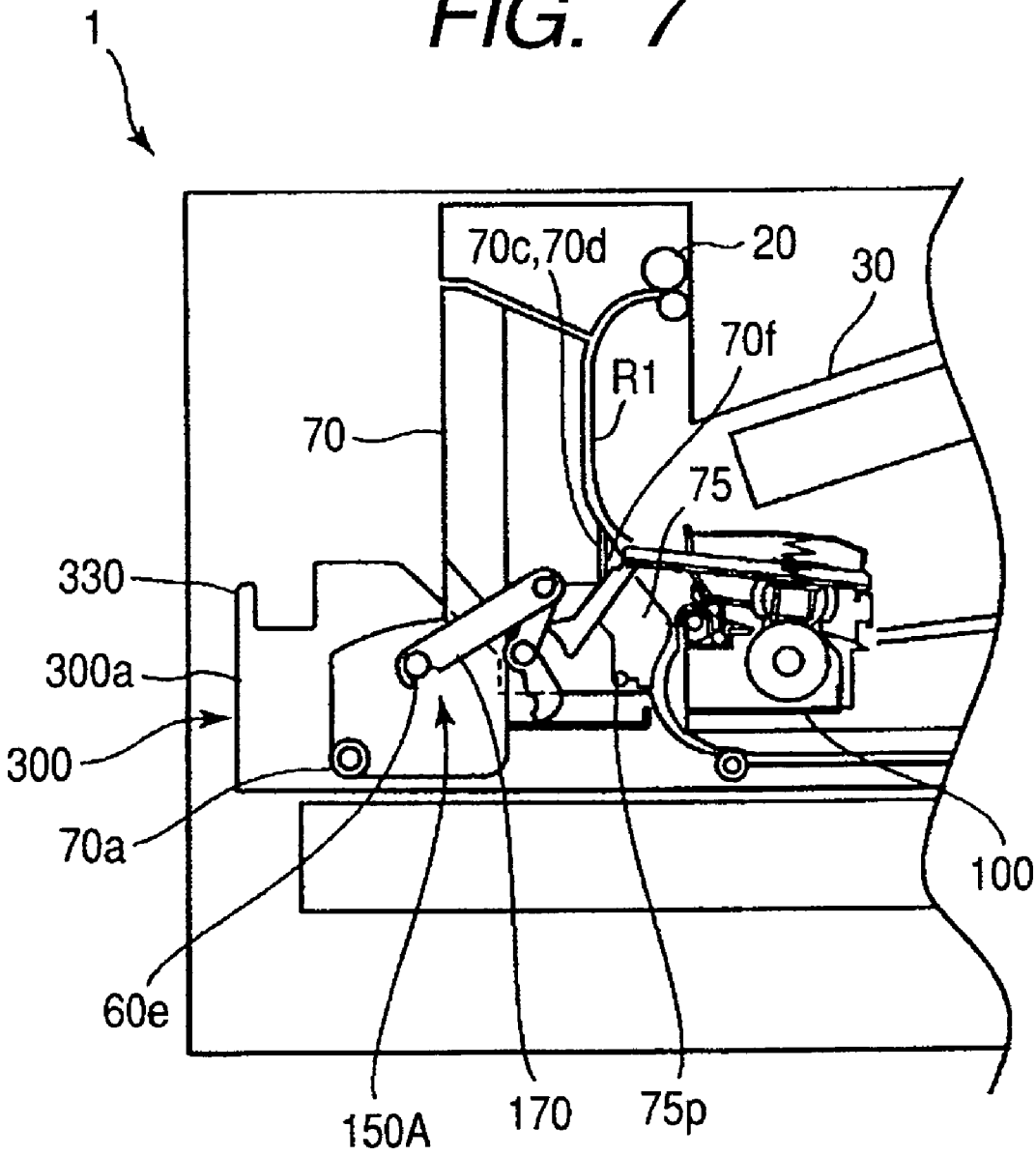
FIG. 7 shows the essential portions of a laser printer, which is an example of an image forming apparatus according to a second embodiment of the present invention.

FIG. 7 shows the essential portions of a laser printer which is an example of an image forming apparatus according to the present embodiment. In FIG. 7, the same reference characters as those in FIG. 1 designate the same or corresponding portions.

In FIG. 7, the reference numeral 70 designates an exterior cover, and the reference numeral 75 denotes an inner guide which is a conveying guide pivotally movably provided between the exterior cover 70 and the fixing device 100, and in the present embodiment, design is made such that the FD conveying path R1 is formed between the exterior cover 70 and the inner guide 75.

This inner guide 75 is provided in the apparatus main body for pivotal movement by a shaft 75*p* which is a pivotal movement center differing from a shaft 70*a* which is the rotation center of the exterior cover 70 and also, is biased in a direction to be counter-clockwisely pivotally moved by biasing means (not shown). Usually, when the exterior cover 70 is closed, the ramming portions 70*c* and 70*d* of the exterior cover 70 are adapted to abut against the inner guide 75 against the biasing means (not shown) whereby the position of the conveying path is determined.

Figure 8:
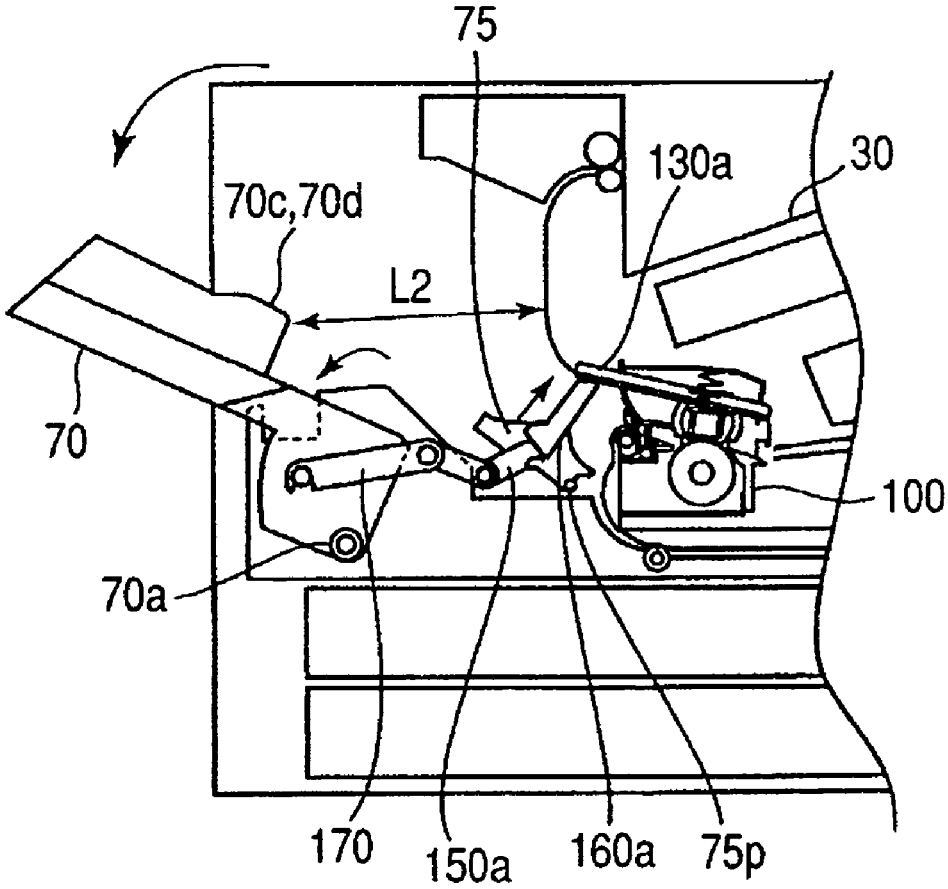
FIG. 8 illustrates the operation of nip pressure releasing means when an exterior cover provided on the laser printer of FIG. 7 is opened.

Also, when the exterior cover 70 is opened, as in the already described first embodiment, the fulcrum 60*e* provided on the exterior cover 70 is moved from in the counter-clockwise direction from its position shown in FIG. 7 by the nip pressure releasing means 150A, and along therewith, the link 170 is moved to the outside as shown in FIG. 8, and by this movement of the link 170, the nip pressure releasing cams 150*a* and 150*b* are also counter-clockwisely rotated.

When the nip pressure releasing cams 150*a* and 150*b* are thus counter-clockwisely rotated, the nip pressure releasing levers 160*a* and 160*b* are moved in the direction indicated by the arrow (obliquely upwardly) in FIG. 8. Further, by such movement of the nip pressure releasing levers 160*a* and 160*b*, the pressure plates 130*a* and 130*b* are clockwisely pivotally moved to thereby release a force biasing the heater stay 106 to the pressure roller 103 side while compressing the biasing spring 110. Thereby, the pressure contact of the fixing means 101, i.e., the pressure contact between the heater 104 and the pressure roller 103, is released, and the nip pressure to the sheet is released.

Now, when the exterior cover 70 is opened, the pressure contact by the ramming portions 70*c* and 70*d* of the exterior cover 70 is released and therefore, the inner guide 75 being biased by the biasing means (not shown) is counter-clockwisely pivotally moved about a shaft 75*p* and is inclined, and is stopped at a predetermined position indicated in FIG. 8.

Here, as in the present embodiment, the pivotally movable inner guide 75 is provided between the exterior cover 70 and the fixing device 100, whereby the shaft 70*a* of the exterior cover 70 can be positioned more to the outside of the apparatus main body than the shafts 60*c* and 60*d* of the exterior cover 60 in the already described first embodiment shown, for example, in FIG. 3, whereby when the exterior cover 70 is opened, the width L2 of the jam clearance space can be secured large as compared with the width L1 (see FIG. 6) of the jam clearance space in the already described first embodiment.

Figure 9:
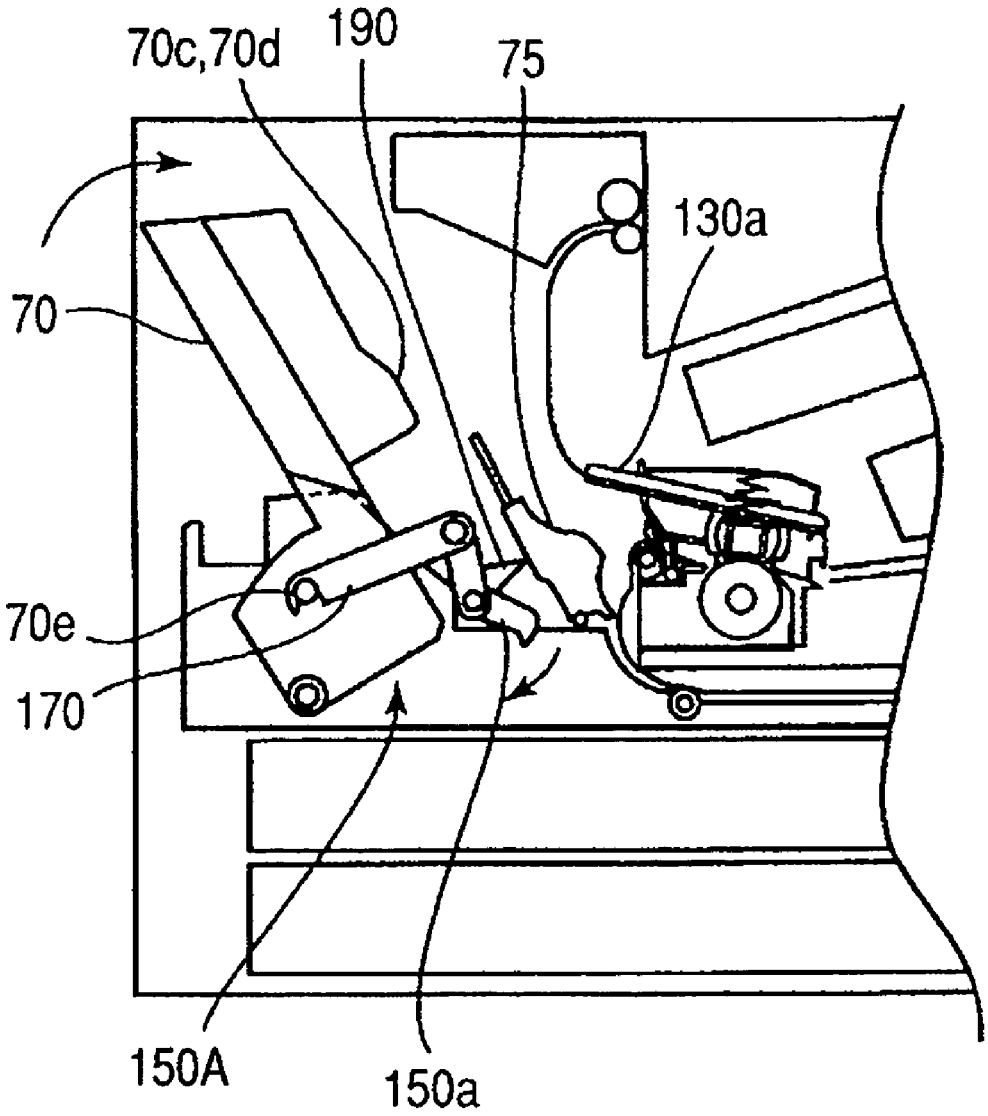
FIG. 9 illustrates the operation of the nip pressure releasing means when the exterior cover is closed.

On the other hand, when the exterior cover 70 is closed after jam clearance has been performed, the fulcrum 60*e* of the link 70 provided on the exterior cover 70 is first clockwisely moved and the link 170 is moved to the inside, and along therewith, the nip pressure releasing cam 150*a* is also clockwisely rotated as shown in FIG. 9.

Figure 10:
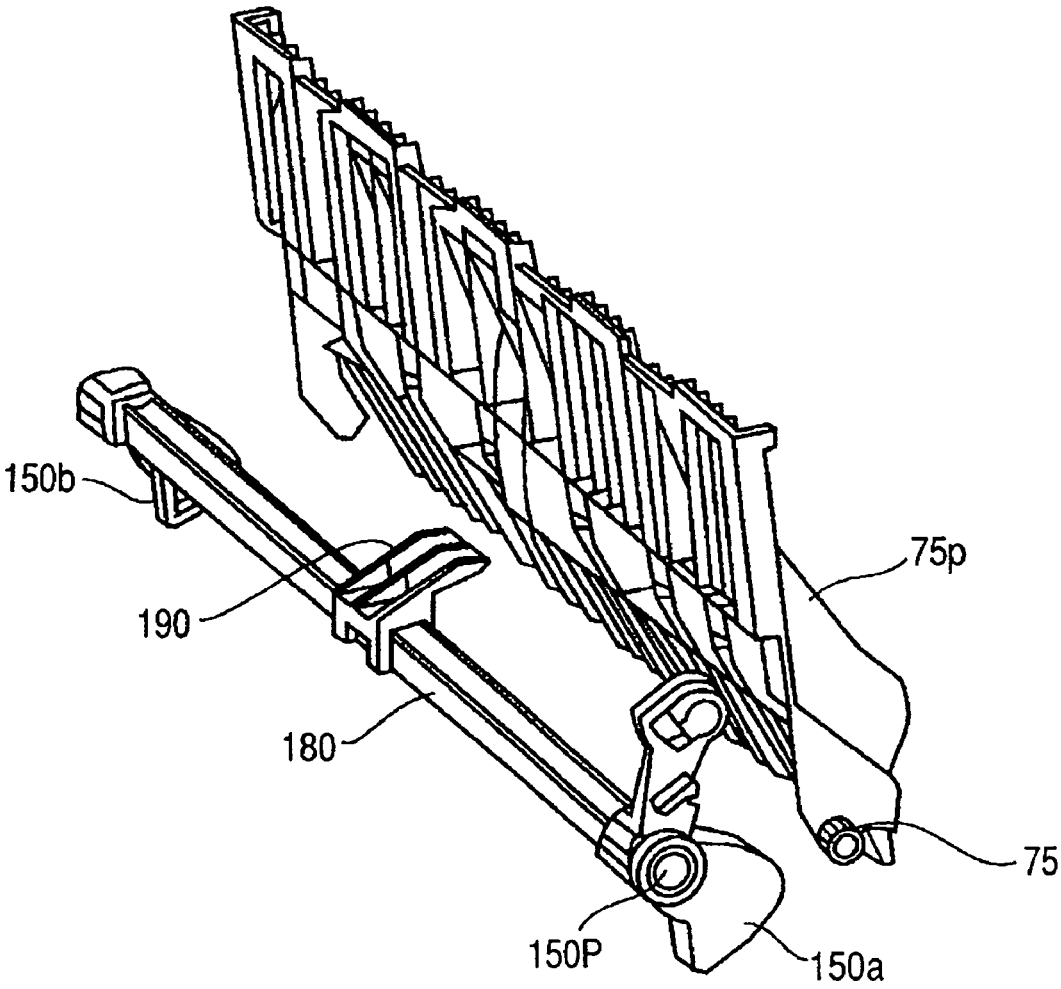
FIG. 10 is a perspective view illustrating a nip pressure releasing cam and an inner guide returning cam constituting the nip pressure releasing means.

Here, as shown in FIG. 10, an inner guide returning cam 190 is fixed to a shaft 180 to which the fore and rear nip pressure releasing cams 150*a* and 150*b* are fixed, and by the nip pressure releasing cams 150 being rotated, the inner guide returning cam 190 is clockwisely rotated integrally with the shaft 180 and contacts with the inner guide 75, and thereafter clockwisely pivotally moves the inner guide 75 to a predetermined angle. Thereafter, the exterior cover 70 is further pivotally moved, the ramming portions 70*c* and 70*d* of the exterior cover 70 contact with the inner guide 75 to thereby further clockwisely move the inner guide 75 and return it to its home position.

Also, in operative association with this operation, the nip pressure releasing levers 160 are moved obliquely downwardly as viewed in FIG. 8 by the rotation of the nip pressure releasing cams 150, and further, by such movement of the nip pressure releasing levers 160*a* and 160*b*, the pressure plates 130*a* and 130*b* are counter-clockwisely pivotally moved and also, the heater stay 106 is biased toward the pressure roller 103 side by the biasing spring 110, and the heater 104 comes into pressure contact with the pressure roller 103, whereby nip pressure against the sheet is generated.

As described above, according to the present embodiment, the nip pressure of the fixing means 101 of the fixing device 100 can be released simply by opening the exterior cover 70, without moving the duplex unit 300, and it becomes possible to provide a printer of good usability which can perform jam clearance by one step. Further, the FD conveying path R1 can be formed by the exterior cover 70 and the inner guide 75 differing in rotation center from each other, whereby a wide jam clearance space can be secured.

Description will now be made of a third embodiment of the present invention.

Figure 11A:
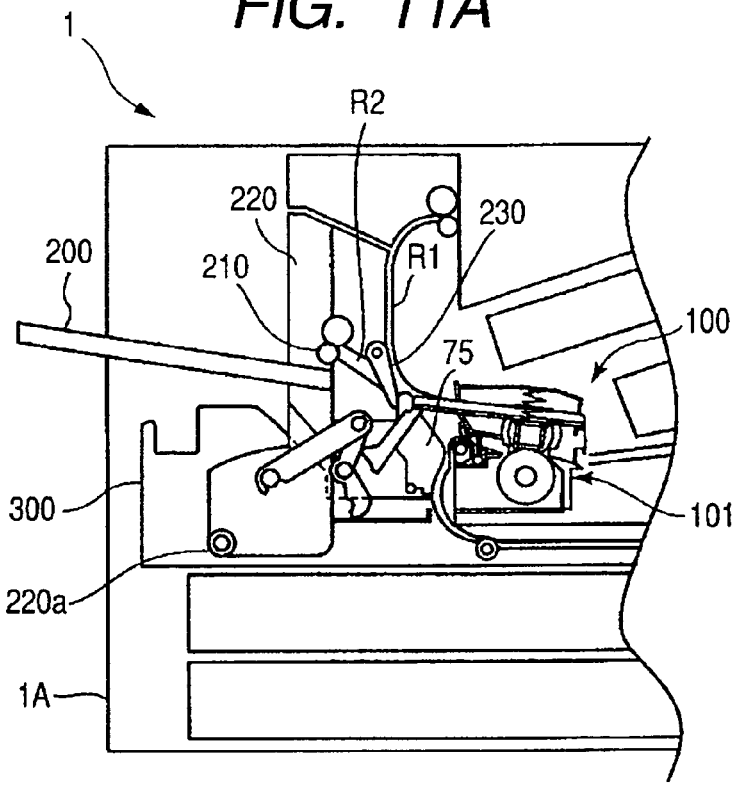
FIGS. 11A and 11B show the essential portions of a laser printer which is an example of an image forming apparatus according to a third embodiment of the present invention.
Figure 11B:
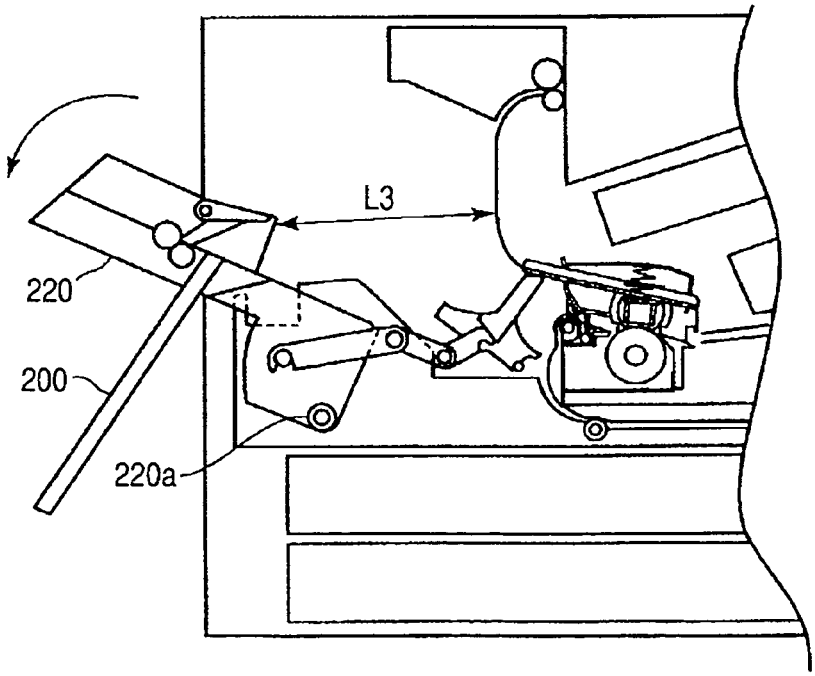

FIGS. 11A and 11B show the essential portions of a laser printer which is an example of an image forming apparatus according to the present embodiment. In FIGS. 11A and 11B, the same reference characters as those in FIG. 1 designate the same or corresponding portions.

In FIGS. 11A and 11B, the reference numeral 220 designates an exterior cover, and this exterior cover 220 is provided with an FU tray 200 which is sheet stacking means providing an FU (face-up) sheet discharging portion. Also, the reference character R2 denotes an FU (face-up) stacking route for causing a sheet fixed by the fixing device 100 to travel to the FU tray 200, and the reference character 230 designates a flapper for performing the changeover of this FU stacking route R2 and the FD conveying path R1.

By the exterior cover 220 being provided with the FU tray 200 as described above, the sheet fixed by the fixing device 100 becomes capable of being discharged in a face-up state.

Even though the FU tray 200 is thus provided on the exterior cover 220, even if the exterior cover 220 is pivotally moved with a shaft 220*a* as the rotation center, as shown in FIG. 11B, it will never happen that the exterior cover 220 contacts with the duplex unit 300, and the nipping force of the fixing means 101 can be released to thereby sufficiently secure a jam clearance space L3.

Even in a case where the exterior cover 220 is provided with the FU tray 200, as described above, the nip pressure of the fixing means 101 of the fixing device 100 can be released simply by opening the exterior cover 220, without moving the duplex unit 300, and it becomes possible to provide a printer of good usability which can perform jam clearance by one step.

Figure 12:
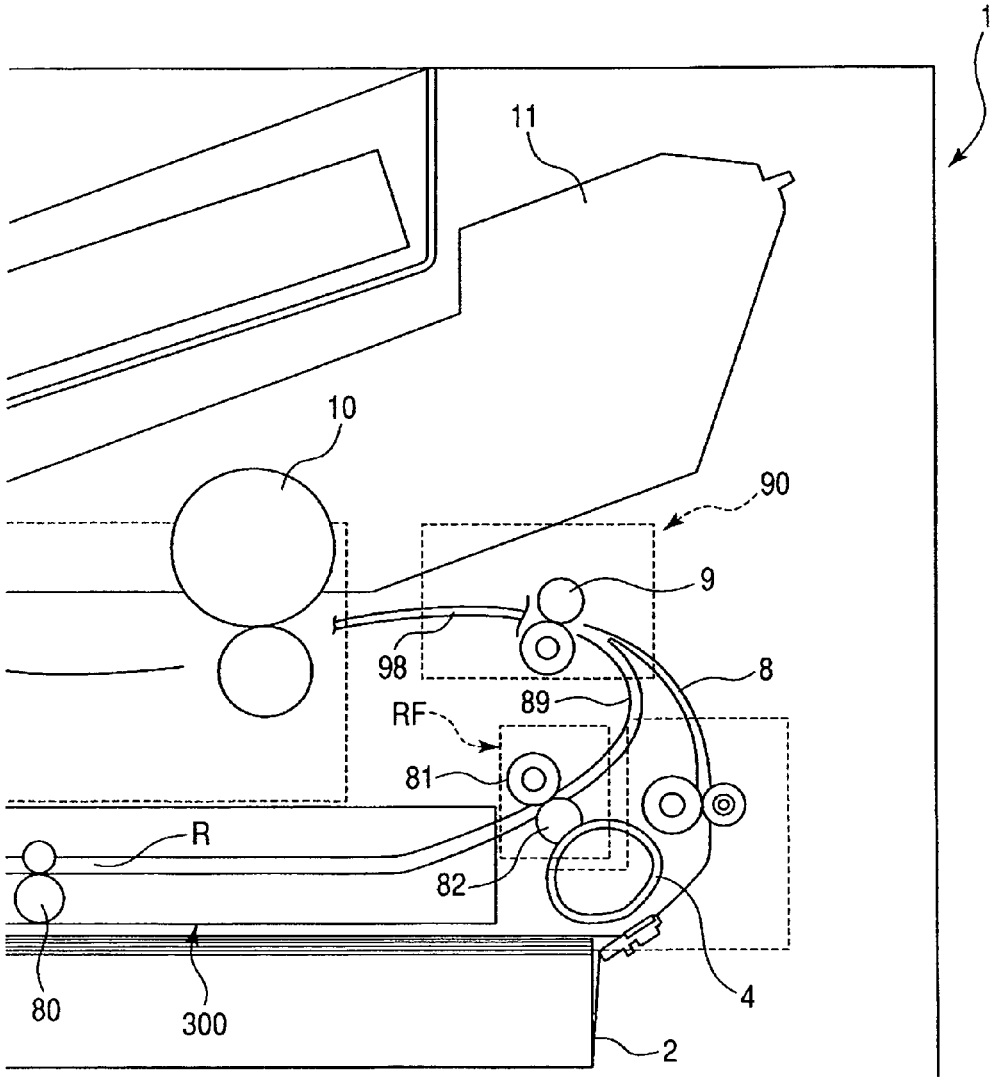
FIG. 12 is a cross-sectional view of the image forming apparatus along a sheet conveying direction showing a state in which a reconveying portion is mounted on an apparatus main body.
Figure 13:
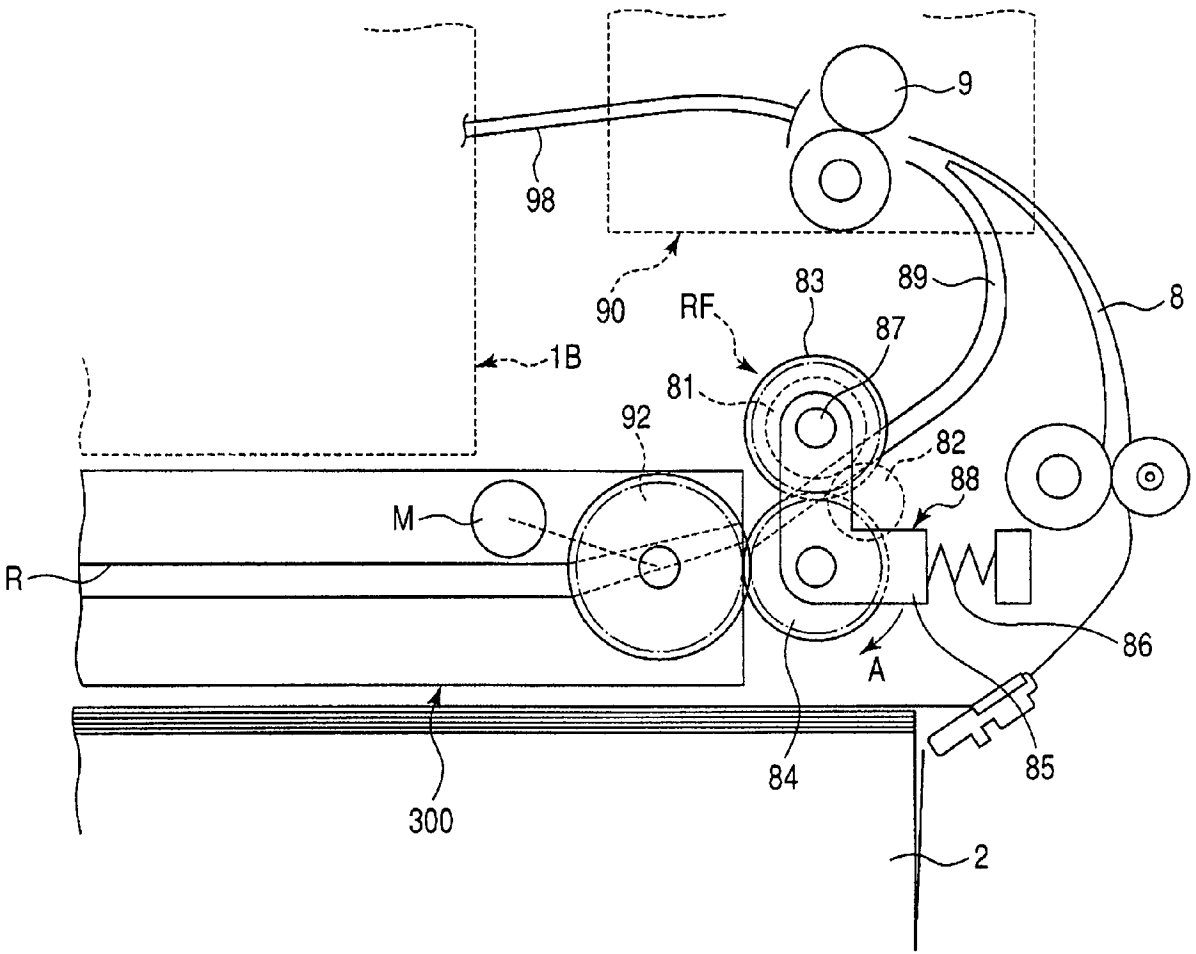
FIG. 13 is an enlarged view of a portion of the reconveying portion and a sheet refeeding portion in FIG. 12.
Figure 14:
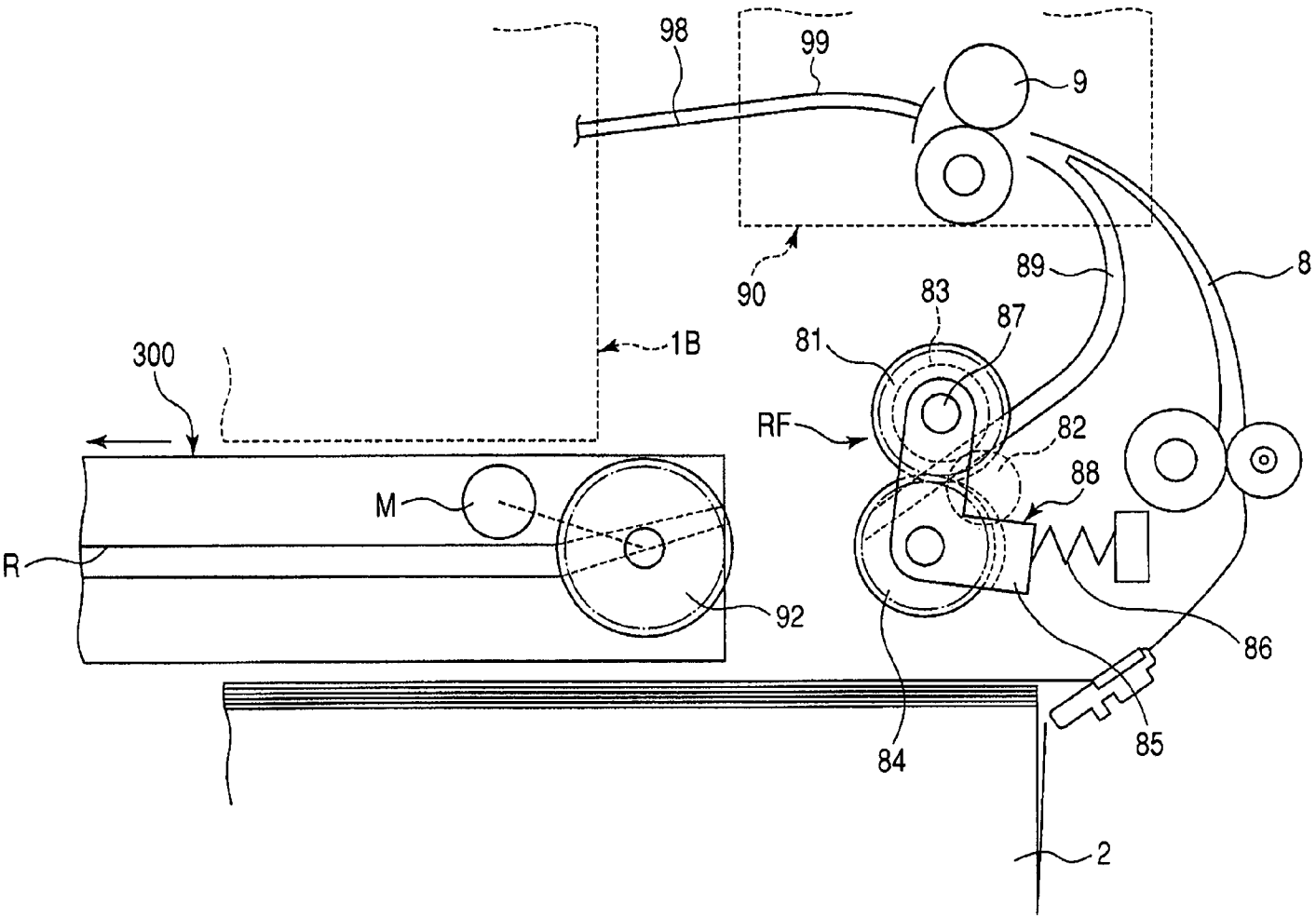
FIG. 14 shows a state in which the reconveying portion has been slightly drawn out of the apparatus main body from the state of FIG. 13.
Figure 15:
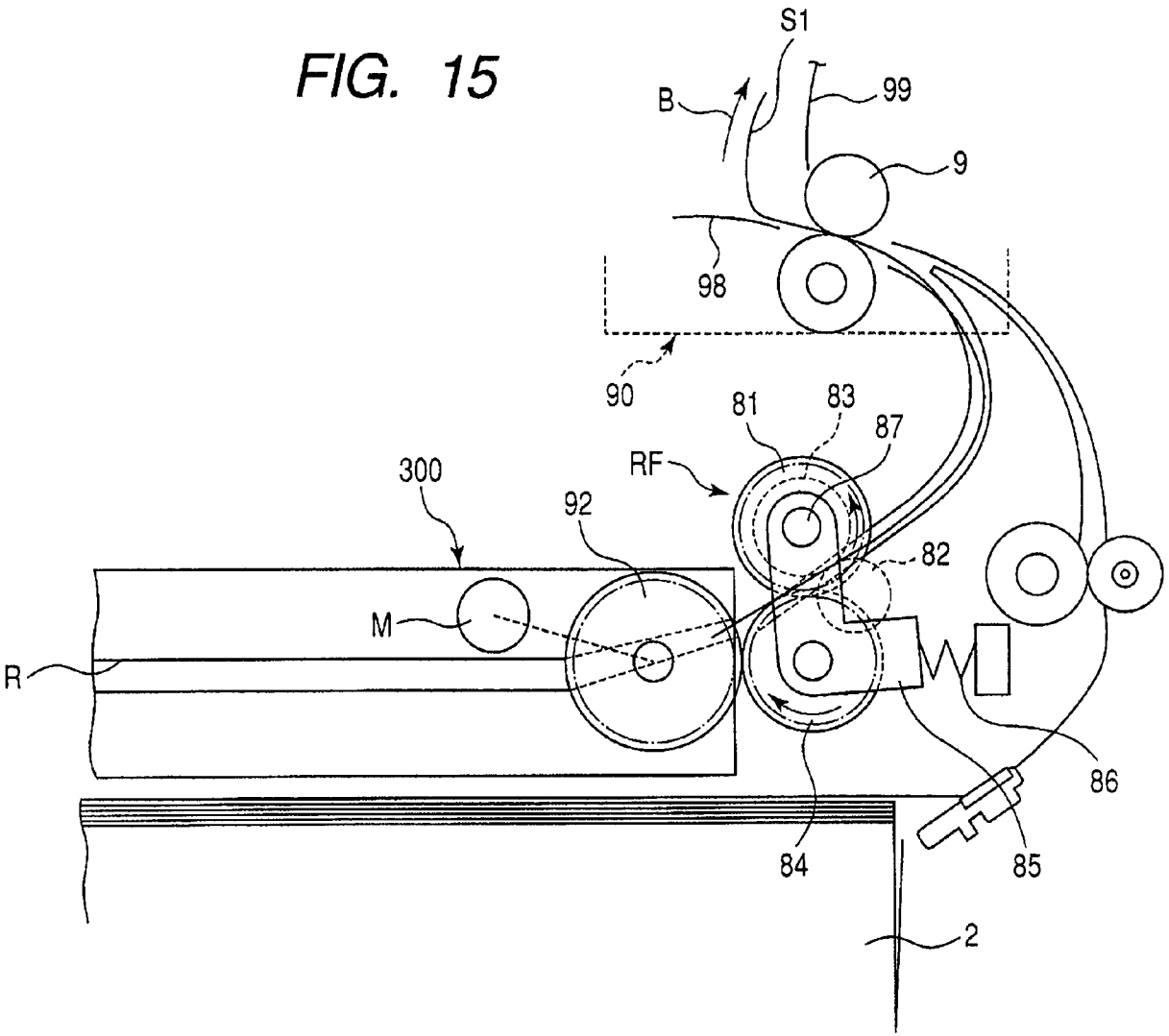
FIG. 15 is a view for illustrating a jam clearing operation in a state in which the reconveying portion is mounted.

A sheet refeeding portion provided in the laser printer 1 will now be described with reference to FIGS. 12 to 18. FIG. 12 is a cross-sectional view of the essential portions taken along the sheet conveying direction of the laser printer 1. FIG. 13 is an enlarged view of a portion of the duplex unit 300 and the sheet refeeding portion. FIG. 14 shows a state in which the duplex unit 300 has been slightly drawn out of the apparatus main body from the state of FIG. 13. FIG. 15 is a view for illustrating the jam clearing operation in a state in which the duplex unit 300 has been mounted.

The sheet refeeding portion RF is for feeding to the registration portion 90 a sheet having an image formed on a first side thereof, and reversed and conveyed by the duplex unit 300.

The duplex unit 300 is provided with a duplex conveying path R for guiding a resupplied sheet, a pair of sheet refeeding and conveying rollers 80 for conveying the resupplied sheet, a motor M as a drive source, a sheet refeeding and driving gear 92 rotated by the motor M, etc. The duplex unit 300 is an option, and is adapted to be capable of being detachably mounted on the apparatus main body 1A of the laser printer 1. The motor M is provided near the sheet refeeding and driving gear 92, but may be provided anywhere in the duplex unit 300. The sheet refeeding portion RF is incorporated in the laser printer 1, and is separated from the duplex unit 300. The sheet refeeding portion RF is for temporarily stopping the sheet conveyed from the duplex unit 300, and feeding out the stopped sheet in timed relationship with a sheet from a sheet cassette 2. The sheet refeeding portion RF is provided with a sheet refeeding roller 81 rotated by the drive from the motor M, and a sheet refeeding runner 82 provided in pressure contact with the sheet refeeding roller 81.

The duplex unit 300 and the sheet refeeding portion RF are disposed between the sheet cassette 2 and the image forming portion 1B. Therefore, the distance from the sheet refeeding portion RF to the image forming portion 1B is shorter than the distance from the sheet cassette 2 to the image forming portion 1B. This difference between the two distances gives birth to a surplus in the time for temporarily stopping the sheet conveyed from the duplex unit 300, and the sheet refeeding portion RF can easily take timing with the sheet from the sheet cassette 2, and can feed the sheet into the image forming portion 1B without causing jam.

Description will be made here of the reason why the sheet refeeding portion RF is incorporated in the laser printer 1 side. The reconveying route 89 between the sheet refeeding portion RF and the registration portion 90 is disposed inside the conveying route 8 for guiding the sheet fed from the sheet cassette 2 and therefore is smaller in radius of curvature and greater in conveying resistance than the conveying route 8. So, in order that the sheet refeeding portion RF may be made capable of conveying even a sheet of great rigidity (a sheet of strong rigidity) against the conveying resistance, the sheet refeeding portion RF is incorporated in the apparatus main body 1A of the laser printer 1, and is disposed as near as possible the registration portion 90. If the sheet refeeding portion RF is incorporated in the duplex unit 300 at all, the sheet refeeding portion RF will become far away from the registration, portion 90, and faulty feeding may be caused by the conveying resistance of the sheet refeeding route 89. Also, if an attempt is made to bring the sheet refeeding portion RF close to the registration portion 90 in a state in which it has been incorporated in the duplex unit 300, the duplex unit 300 will become bulky and the laser printer 1 will become large.

The sheet refeeding portion RF will now be described with reference to FIG. 13. A sheet refeeding roller gear 83 for rotating the sheet refeeding roller 81 is provided on the shaft 87 of the sheet refeeding roller 81. Also, a sheet refeeding rockable holder 85 is rotatably provided on the shaft 87 of the sheet refeeding roller 81. A sheet refeeding rockably gear 84 is rotatably provided on the sheet refeeding rockable holder 85. A sheet refeeding rockable spring 86 biases the sheet refeeding rockable holder 85 in the direction indicated by the arrow A. The sheet refeeding rockable holder 85 is adapted to be stopped by a stopper (not shown) so as not to rotate by a predetermined angle or greater. Therefore, when the sheet refeeding portion RF has been mounted on the apparatus main body 1A, the sheet refeeding rockable gear 84 is biased so as to mesh with the sheet refeeding and driving gear 92 by the sheet refeeding rockable spring 86, but the gears are adapted not to strike against each other by their tooth bottoms.

The sheet refeeding rockable gear 84 and the sheet refeeding driving gear 92 as rotary members are a pair of driving force transmitting rotary members, and are designed such that the distance between their shafts is kept by a restraining portion (not shown). Also, the sheet refeeding roller gear 83, the sheet refeeding rockable gear 84, the sheet refeeding rockable holder 85, the sheet refeeding rockable spring 86, etc. together constitute a rotary member spacing-apart mechanism 88 as rotary member spacing-apart means.

Description will now be made of the operation of reversing a sheet having an image formed on a first side thereof and conveying it in the duplex unit 300 in order to form an image on a second side of the sheet. A controlling portion 103 starts the motor M provided in the duplex unit 300 to thereby rotate the pair of sheet refeeding and conveying rollers 80 and the sheet refeeding and driving gear 92. The pair of sheet refeeding and conveying rollers 80 continue the conveyance of the reversed sheet and conveys it to the sheet refeeding portion RF. The sheet refeeding roller 81 of the sheet refeeding portion RF receives a rotating force from the sheet refeeding driving gear 92 being already rotated through the sheet refeeding rockable gear 84 and the sheet refeeding roller gear 83 and is rotated thereby. Therefore, the sheet refeeding roller 81 and the sheet refeeding runner 82 feeds the resupplied sheet into the registration portion 90. The registration portion 90 in turn feeds the resupplied sheet into the image forming portion 1B. Thereafter, the laser printer 1 transfers and fixes a toner image also to and on the other side of the sheet in the same manner as when it transferred and fixed the toner image to and on the first side of the sheet, and discharges the sheet onto the discharge tray 30.

Description will now be made of the movement of the duplex unit 300 and the sheet refeeding portion RF when the duplex unit 300 is drawn out of the apparatus main body 1A.

The sheet refeeding and driving gear 92 is adapted to separate from the sheet refeeding rockable gear 84 and therefore, the duplex unit 300 is adapted to be capable of being pulled out of the apparatus main body 1A. Accordingly, the duplex unit 300 is adapted to be capable of being detachably mounted on the apparatus main body 1A as an option. Also, when the duplex unit 300 is drawn out of the apparatus main body 1A, the sheet refeeding and driving gear 92 separates from the sheet refeeding rockable gear 84, and the sheet refeeding roller 81 assumes a rotatable state. Therefore, a jamming sheet occurring in the duplex unit 300 or the sheet refeeding portion RF can be removed easily. Also, the laser printer 1 according to the present embodiment is adapted to permit the jamming sheet S1 to be easily removed even if as shown in FIG. 15, the duplex unit 300 is not pulled out of the apparatus main body 1A. That is, if the user takes the process cartridge 11 of the image forming portion 1B out of the apparatus main body 1A, and opens the conveying upper guide 99 as the side wall of the conveying guide 98 as a guide path for guiding the sheet from the registration portion 90 to the image forming portion 1B, and then attempts to pull out the jamming sheet S1 in the direction indicated by the arrow B, the sheet refeeding roller 81 is rotated in the counter-clockwise direction. Thereupon, the sheet refeeding gear 83 is rotated in the counter-clockwise direction, and the sheet refeeding rockable gear 84 is rotated in a clockwise direction. When the sheet refeeding rockable gear 84 is rotated in the clockwise direction, the rotating force thereof acts on the sheet refeeding and driving gear 92 and the sheet refeeding rockable holder 85 is rotated in the counter-clockwise direction. As the result, the meshing engagement between the sheet refeeding rockable gear 84 and the sheet refeeding and driving gear 92 is released, and the sheet refeeding rockable gear 84, the sheet refeeding roller gear 83 and the sheet refeeding roller 81 become rotatable, and the jamming sheet S can be easily pulled out in the direction indicated by the arrow B.

In the above-described laser printer 1, the sheet refeeding portion RF is made detachably mountable with respect to the apparatus main body 1A and the sheet refeeding portion RF is provided with the motor M for driving the sheet refeeding and driving gear 92 and the removably insertable retrofitted reconveying portion is given the driving of the sheet refeeding portion RF and therefore, in a case where a toner image is formed only on one side of the sheet, a drive source for the sheet refeeding portion RF and the parts of a driving system related to this drive source can be curtailed and the structure of the printer can be simplified and downsized. Also, the cost can be reduced.

Also, in the above-described laser printer 1, the sheet refeeding rockable gear 84 is rockable, but the sheet refeeding and driving gear 92 may be made rockable so as to mesh with the sheet refeeding rockable gear 84, or the sheet refeeding rockable gear 84 may be eliminated so that the sheet refeeding and driving gear 92 may mesh with the sheet refeeding roller gear 83. Also, only the reverse rotation of the pair of discharge rollers 71 of the sheet discharge portion 7 may be performed by the motor M provided in the duplex unit 300.

Figure 16:
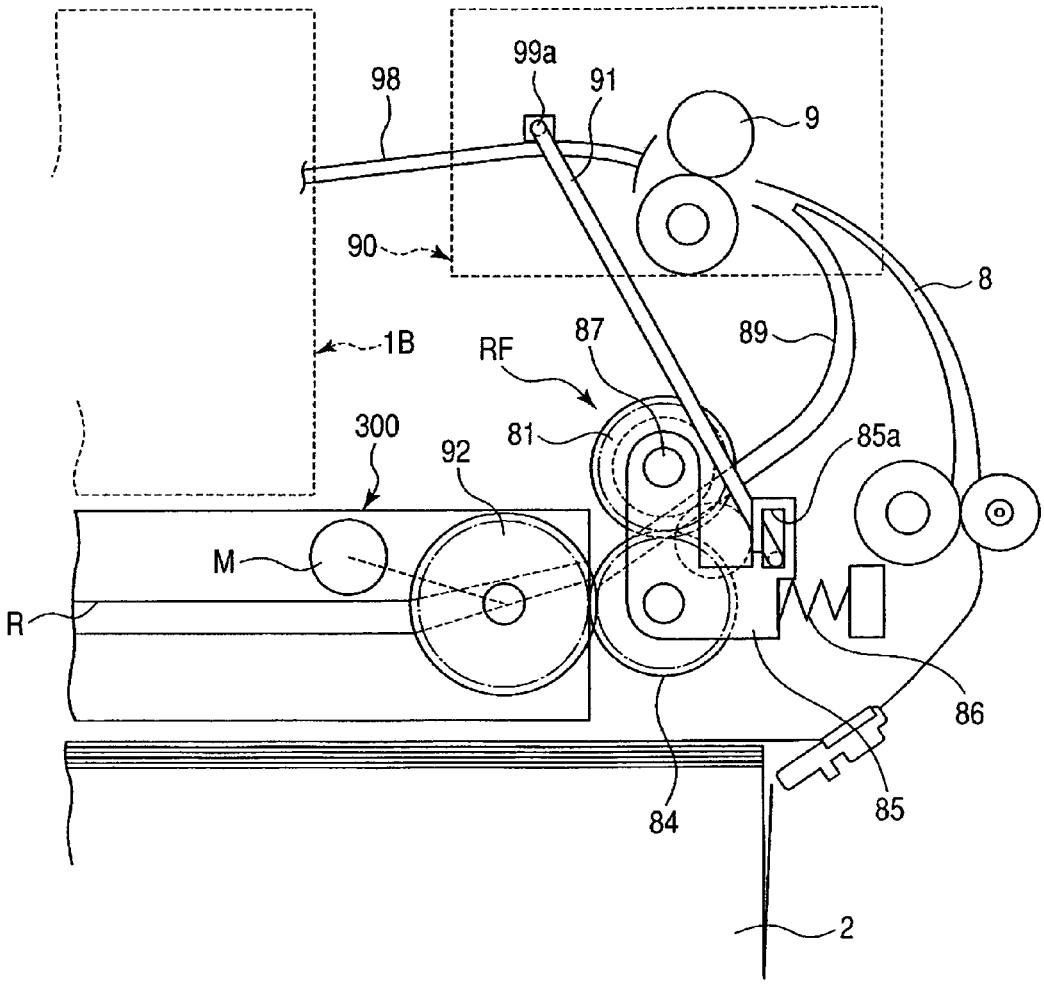
FIG. 16 shows other structure for facilitating the removable of a jamming sheet.
Figure 17:
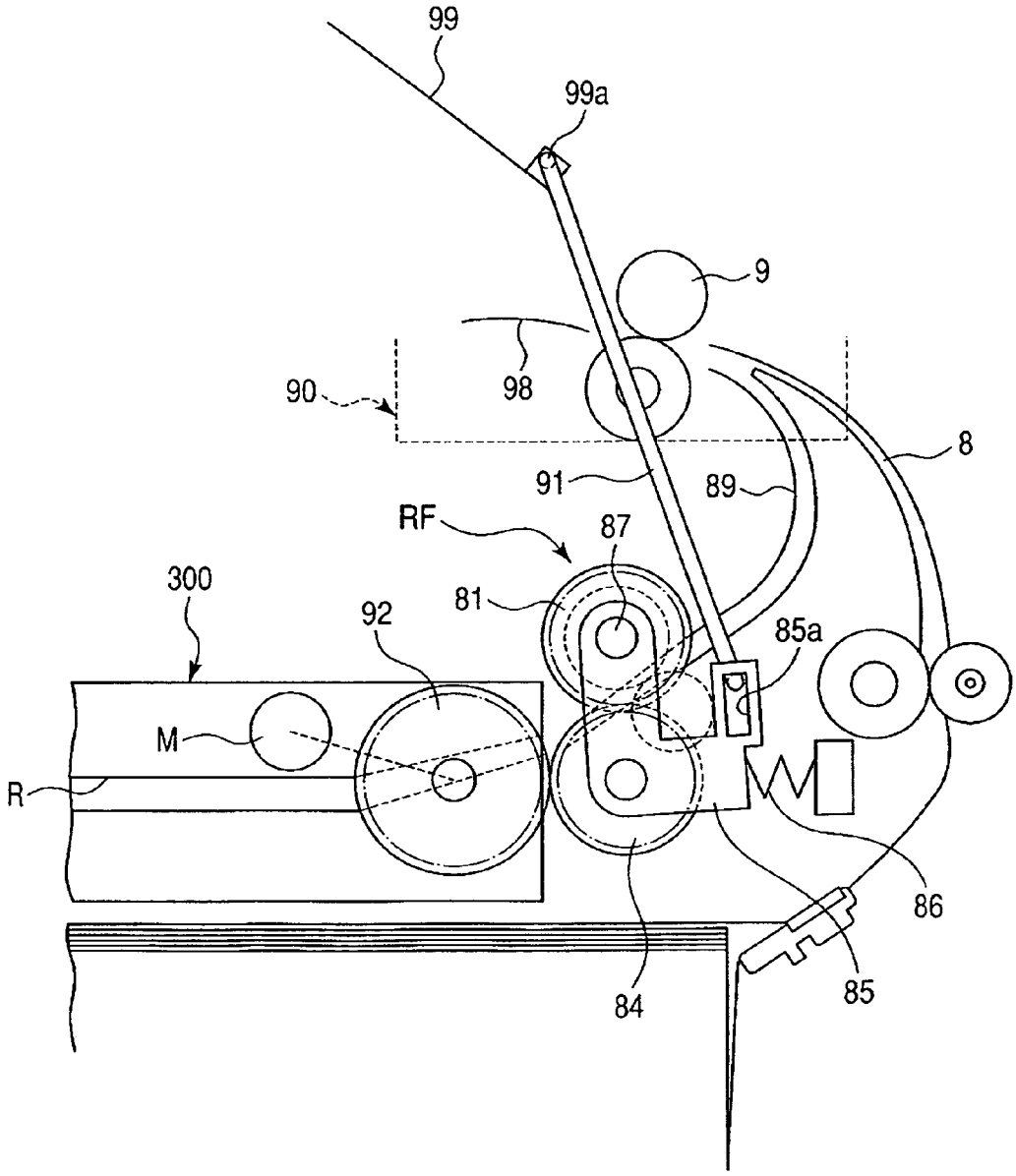
FIG. 17 shows the state when the jamming sheet is removed in FIG. 16.
Figure 18:
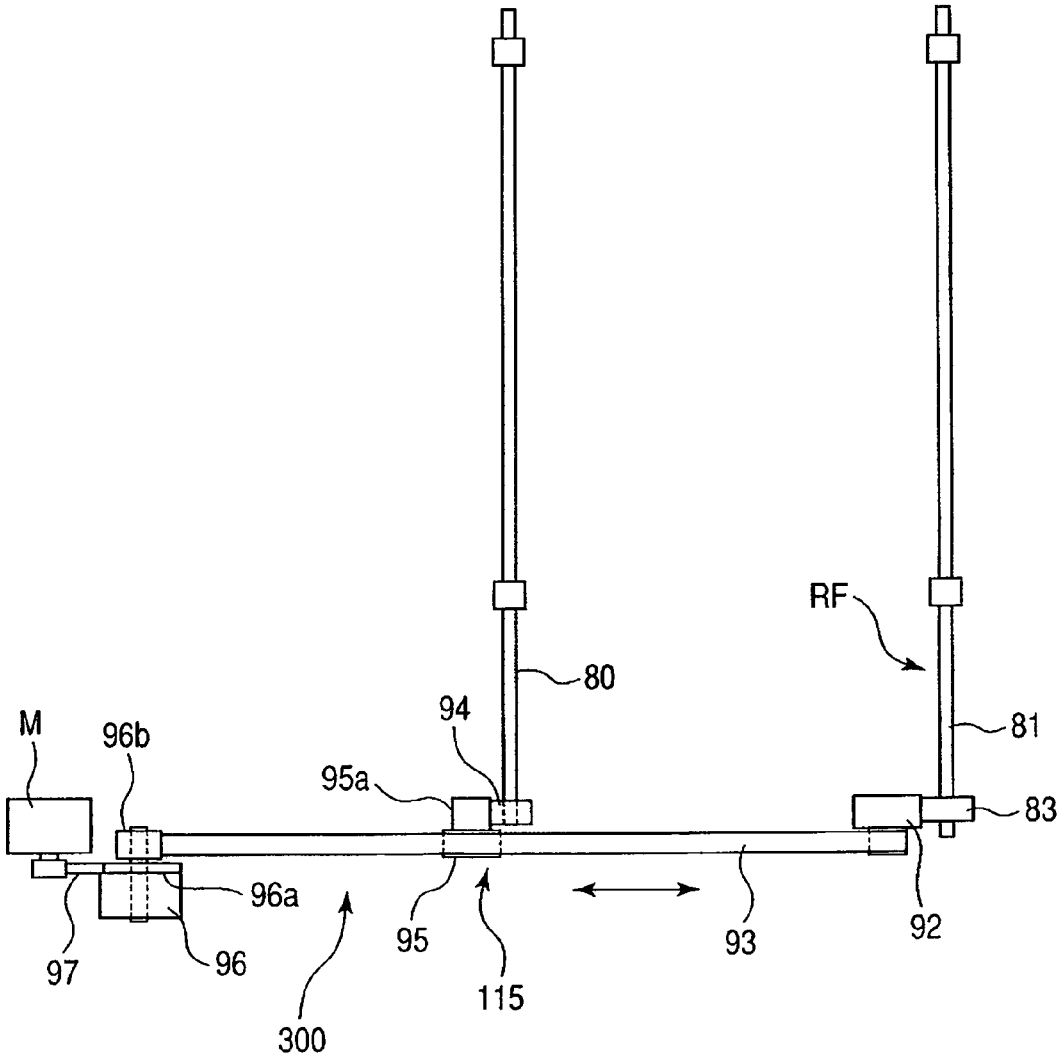
FIG. 18 is a plan view of the driving system of the reconveying portion in a case where a clutch is provided.
Figure 19A:
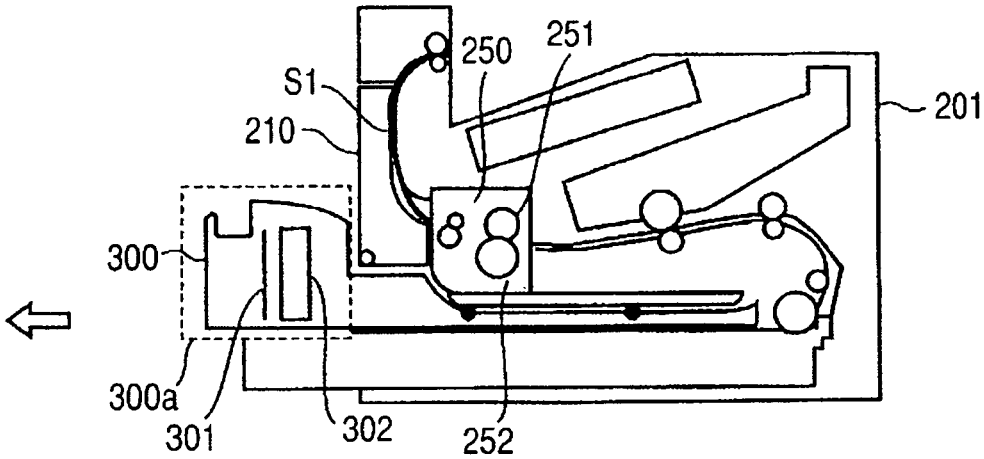
FIGS. 19A and 19B schematically show the construction of a laser printer which is an example of a conventional image forming apparatus.
Figure 19B:
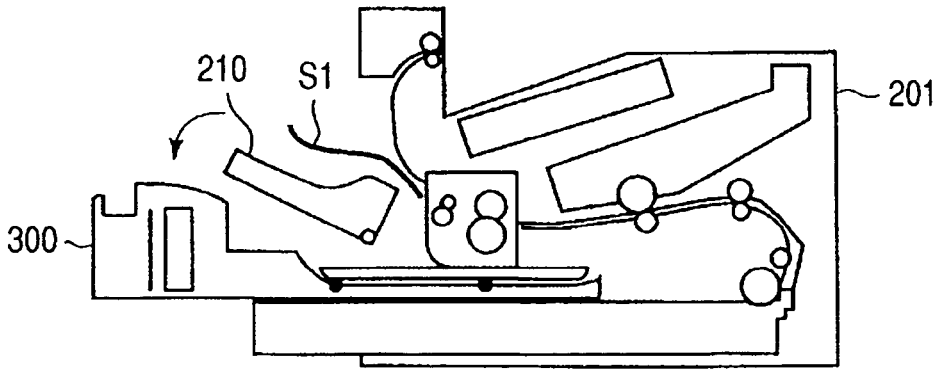

Further, a sheet refeeding driving clutch 96 shown in FIG. 18 may be provided between the motor M and the sheet refeeding and driving gear 92 shown in FIGS. 13 to 17. In this case, the sheet refeeding roller gear 83 and the sheet refeeding roller 81 can be designated to be capable of being reliably idly rotated, and in the work of removing a jamming sheet by pulling it, it becomes less often for the jamming sheet to be torn.

Now, with reference to FIG. 15, description has been made of bringing the sheet refeeding roller 81 and the sheet refeeding runner 82 into their rotatable state by the utilization of the jamming sheet being pulled from the outside in order to remove the jamming sheet nipped between the sheet refeeding roller 81 and the sheet refeeding runner 82, but as shown in FIGS. 16 and 17, by the utilization of the user opening the conveying upper guide 99 of the conveying guide 98, the sheet refeeding rockable gear 84 may be forcibly spaced apart from the sheet refeeding and driving gear 92 to thereby bring the sheet refeeding roller 81 and the sheet refeeding runner 82 into their rotatable state.

That is, in FIGS. 16 and 17, the conveying upper guide 99 of the conveying guide 98 provided downstream of the registration rollers 51 of the registration portion 90 is pivotally movably mounted at the rotation center of the pair of registration rollers 51. A connecting rod 91 as spacing-apart means is connected to the connecting point 99*a* of the conveying upper guide 99 and a connecting slit 85*a* on the sheet refeeding rockable holder 85. When as shown in FIG. 17, the user pivotally moves the conveying upper guide 99 to thereby open the conveying guide 98, the sheet refeeding rockable holder 85 is counter-clockwisely rotated by the connecting rod 91 to thereby separate the sheet refeeding rockable gear 84 from the sheet refeeding driving gear 92 and release the meshing engagement between the two.

As the result, the sheet refeeding roller 81 becomes rotatable and the load when the sheet is pulled out is mitigated, and it becomes less often for the jamming sheet to be torn and the jamming sheet is removed easily. Again in this case, the duplex unit 300 need not be drawn out of the apparatus main body 1A and thus, the jamming sheet removing work can be done easily.

Also, in the foregoing description, the meshing engagement between the sheet refeeding driving gear 92 and the sheet refeeding rockable gear 84 is released so that the sheet refeeding roller 81 and the sheet refeeding runner 82 can be idly rotated, but as shown in FIG. 18, a clutch may be provided in the driving system so that the sheet refeeding roller 81 and the sheet refeeding runner 82 can be idly rotated.

That is, as shown in FIG. 18 which is a plan view of the drive transmitting portion 115 of the duplex unit 300, the drive transmitting portion 115 transmits the rotation of the motor M to a conveying roller driving pulley 95 and the sheet refeeding driving gear 92 through a drive transmitting gear 97, a drive receiving gear 96*a*, a sheet refeeding and driving clutch 96 and a drive transmitting belt 93. The conveying roller driving pulley 95 rotates the pair of sheet refeeding and conveying rollers 80 through a conveying gear 95*a* integral with the conveying roller driving pulley 95, and a conveying roller gear 94. Also, the sheet refeeding and driving gear 92 rotates the sheet refeeding roller 81 through the sheet refeeding roller gear 83.

When the drive transmitting portion 115 conveys the resupplied sheet, the sheet refeeding and driving clutch 96 is brought into a rotating force transmitting state to thereby transmit the rotating force of the motor M to the pair of sheet refeeding and conveying rollers 80 and the sheet refeeding roller 81. When the drive transmitting portion 115 does not convey the resupplied sheet, the sheet refeeding driving clutch 96 assumes a state in which it does not transmit the motive power of the motor. Accordingly, even if the duplex unit 300 is not drawn out of the apparatus main body 1A, the sheet refeeding roller 81 and the sheet refeeding runner 82 assume their rotatable state, and the jamming sheet can be pulled and removed easily. Design is made such that when the duplex unit 300 has been drawn out of the apparatus main body 1A, the sheet refeeding and driving gear 92 separates from sheet refeeding roller gear 83.

This application claims priorities from Japanese Patent Applications No. 2005-088184 filed Mar. 25, 2005 and No. 2005-127191 filed Apr. 25, 2005, which are hereby incorporated by reference herein.

What is claimed is:

1. An image forming apparatus having an image forming portion which forms an image on a sheet, said image forming apparatus comprising:

a sheet conveying path, which guides the sheet on which the image has been formed by said image forming portion to a discharge portion;

an exterior cover, which is pivotally movably provided on said image forming apparatus main body, and opens and closes said sheet conveying path; and a duplex unit, which is provided with a duplex conveying path, which guides the sheet again to said image forming portion to form an image on a second side of the sheet having the image formed on a first side thereof, said duplex unit being detachably mounted on said image forming apparatus main body from a side of said exterior cover, and said duplex unit having a protrusion protruding outwardly from an exterior surface of said exterior cover when said duplex unit has been mounted on said image forming apparatus main body, wherein said exterior cover is formed with a mounting relief portion for mounting said duplex unit on said image forming apparatus main body, and said mounting relief portion is shaped so as not to contact with said protrusion of said duplex unit when said exterior cover is opened.

2. An image forming apparatus according to claim 1, wherein a pivotal movement center of said exterior cover is provided outside both sides of said duplex unit and outwardly from the exterior surface of said exterior cover.

3. An image forming apparatus according to claim 1, wherein said image forming portion has a fixing device that nips the sheet to fix the transferred toner image on the sheet, the image forming apparatus further comprises a nip pressure releasing means for releasing a nip pressure of said fixing device in operative association with an opening and closing operation of said exterior cover.

4. An image forming apparatus according to claim 1, wherein said image forming portion has a fixing device that nips the sheet to fix the transferred toner image on the sheet, and a pivotally movable conveying guide having a pivotal movement center differing from that of said exterior cover is provided between said exterior cover and said fixing device, and in a state in which said exterior cover is closed, said exterior cover and said conveying guide form a sheet conveying path.

5. An image forming apparatus according to claim 1, wherein said duplex unit slides and is detachably mounted with respect to said image forming apparatus main body, and a slide of said duplex unit is disabled when said exterior cover is opened.

6. An image forming apparatus according to claim 5, wherein when said exterior cover is opened, a handle for slide-operating said duplex unit is adapted to be covered with said exterior cover.

7. An image forming apparatus according to claim 1, wherein said exterior cover is provided with sheet stacking means for stacking thereon the sheet discharged with the image formed thereon.

* * * * *